US010886639B2

(12) United States Patent
Hata et al.

(10) Patent No.: US 10,886,639 B2
(45) Date of Patent: Jan. 5, 2021

(54) CONNECTOR

(71) Applicant: KYOCERA Corporation, Kyoto (JP)

(72) Inventors: Tetsuya Hata, Yokohama (JP); Shigeki Ohara, Yamato (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 16/496,353

(22) PCT Filed: Mar. 22, 2017

(86) PCT No.: PCT/JP2017/011535
§ 371 (c)(1),
(2) Date: Sep. 20, 2019

(87) PCT Pub. No.: WO2018/173169
PCT Pub. Date: Sep. 27, 2018

(65) Prior Publication Data

US 2020/0036111 A1 Jan. 30, 2020

(51) Int. Cl.
*H01R 4/2433* (2018.01)
*H01R 11/01* (2006.01)

(52) U.S. Cl.
CPC ..... *H01R 4/2433* (2013.01); *H01R 11/01* (2013.01)

(58) Field of Classification Search
CPC .... H01R 4/2433; H01R 4/2416; H01R 4/245; H01R 4/2456; H01R 11/01; H01R 9/031
USPC ..... 439/402, 404
See application file for complete search history.

(56) References Cited

U.S. PATENT DOCUMENTS

| | | | | |
|---|---|---|---|---|
| 4,954,098 | A * | 9/1990 | Hollingsworth | H01R 4/2433 439/404 |
| 5,123,853 | A * | 6/1992 | Gilbert | H01R 4/2454 439/402 |
| 5,569,882 | A | 10/1996 | Yokoyama et al. | |
| 5,714,717 | A | 2/1998 | Nakagome | |
| 6,398,581 | B1 * | 6/2002 | Baier | H01R 12/616 439/404 |
| 10,468,815 | B2 * | 11/2019 | Hata | H01R 4/2433 |
| 2006/0264091 | A1 * | 11/2006 | Sakiyama | H01R 12/616 439/404 |
| 2010/0124454 | A1 | 5/2010 | Yaworski et al. | |

(Continued)

FOREIGN PATENT DOCUMENTS

| | | | |
|---|---|---|---|
| CA | 2357642 | A1 | 3/2002 |
| DE | 10142363 | A1 | 3/2003 |
| JP | H05-217610 | A | 8/1993 |

(Continued)

*Primary Examiner* — Hien D Vu
(74) *Attorney, Agent, or Firm* — Studebaker & Brackett PC

(57) ABSTRACT

Provided is a connector capable of preventing foreign matter from entering from outside even under a high-vibration or high-temperature environment. The connector (10) according to the present disclosure includes a pair of a first fitting object (16) and a second fitting object (30) capable of being fitted together; a contact (50) provided to at least one of the first fitting object (16) and the second fitting object (30); and a first filler (70*a*) and a second filler (70*b*) provided respectively to the first fitting object (16) and the second fitting object (30), in which the first filler (70*a*) and the second filler (70*b*) are crushed and integrated to each other around the contact (50) when the first fitting object (16) and the second fitting object (30) are fitted together.

6 Claims, 12 Drawing Sheets

(56) References Cited

U.S. PATENT DOCUMENTS

| | | | |
|---|---|---|---|
| 2014/0017913 | A1 | 1/2014 | Colwell |

FOREIGN PATENT DOCUMENTS

| | | | |
|---|---|---|---|
| JP | H11-204192 | A | 7/1999 |
| JP | 3028988 | B2 | 4/2000 |
| JP | 2005-251400 | A | 9/2005 |
| JP | 2012-248527 | A | 12/2012 |
| JP | 2017-001119 | A | 1/2017 |

* cited by examiner

CONNECTOR

TECHNICAL FIELD

The present disclosure relates to a connector configured to prevent foreign matter from entering from outside.

BACKGROUND

In a known connector, a filler is placed in each of a pair of fitting objects to be fitted together to protect a contact portion of a corresponding contact from foreign matter such as water or dust entering from outside when the fitting objects are fitted together.

For example, Patent Literature 1 (PTL 1) discloses a connector in which a drip-proof structure is obtained by bringing a pair of elastic annular members of a grommet into close contact with each other when a cover and a body are fitted together.

CITATION LIST

Patent Literature

PTL 1: JP3028988 (B2)

SUMMARY

Technical Problem

However, when fillers are placed in a pair of fitting objects, respectively, and are in close contact with each other when the fitting objects are fitted together, a surface pressure on a bonding surface is decreased or the bonding surface is peeled off due to vibration of the fillers or thermal expansion of the fillers under a high-temperature condition. As a result, a connector cannot sufficiently prevent foreign matter from entering from outside.

It is therefore an object of the present disclosure to provide a connector configured to prevent foreign matter from entering from outside even in an environment where the vibration is large or the temperature is high.

Solution to Problem

In order to solve the above problem, a connector according to a first aspect of the present disclosure includes:

a pair of a first fitting object and a second fitting object capable of being fitted together;

a contact provided in at least one of the first fitting object and the second fitting object; and a first filler and a second filler provided respectively in the first fitting object and the second fitting object, wherein the first filler and the second filler are crushed and integrated to each other around the contact.

In the connector according to a second aspect of the present disclosure, the first fitting object and the second fitting object are connected to each other by a connecting portion;

the first fitting object or the second fitting object includes the contact having an electrically connecting portion;

the first fitting object or the second fitting object holds a cable; and the contact may be included with electrically connected with the cable in a state in which the first fitting object and the second fitting object are fitted together.

In the connector according to a third aspect of the present disclosure, at least one above-described cable may extend outward from the contact arranged inside of the first filler and the second filler when the first fitting object and the second fitting object are fitted together.

In the connector according to a fourth aspect of the present disclosure, the electrically connecting portion is a press-contact groove;

the first fitting object or the second fitting object holds at least two above-described cables; and the contact may clamp core wires of the cables by the press-contact groove to electrically connect the cables to each other when the first fitting object and the second fitting object are fitted together.

In the connector according to a fifth aspect of the present disclosure, when the first fitting object and the second fitting object are fitted together, a corresponding portion of the cable may be arranged inside of the first filler and the second filler that are crushed and integrated to each other, in a cross-sectional view along a fitting direction.

In the connector according to a sixth aspect of the present disclosure, the first filler and the second filler that are crushed and integrated to each other may expand and contract.

In the connector according to a seventh aspect of the present disclosure, the first filler and the second filler may be composed of a material mainly comprising urethane acrylate.

Advantageous Effect

According to an embodiment of the present disclosure, a connector capable of preventing foreign matter from entering from outside even in an environment where the vibration is large or the temperature is high can be provided.

DETAILED DESCRIPTION

An embodiment of the present disclosure will be described below with reference to the accompanying drawings. In the following description, a front-rear direction, a right-left direction and an up-down direction are based on the directions of the arrows in the figures.

A connector 10 according to an embodiment of the present disclosure may be a branch connector configured to clamp core wires of cables by a press-contact groove to electrically connect the cables to each other, or a board-to-board connector configured to connect two circuit boards to each other. The connector 10 according to an embodiment of the present disclosure may also be a connector configured to connect a plate type connection object such as a flexible printed circuit board (FPC) or a flexible flat cable (FFC) with a circuit board. The connector 10 according to an embodiment of the present disclosure is applicable to any connector configured to effectively prevent foreign matter from entering from outside.

In an embodiment described below, as an example, the connector 10 is illustrated as a branch connector.

First, a structure of the connector 10 loaded with no fillers 70 will be mainly described.

Figure 1:
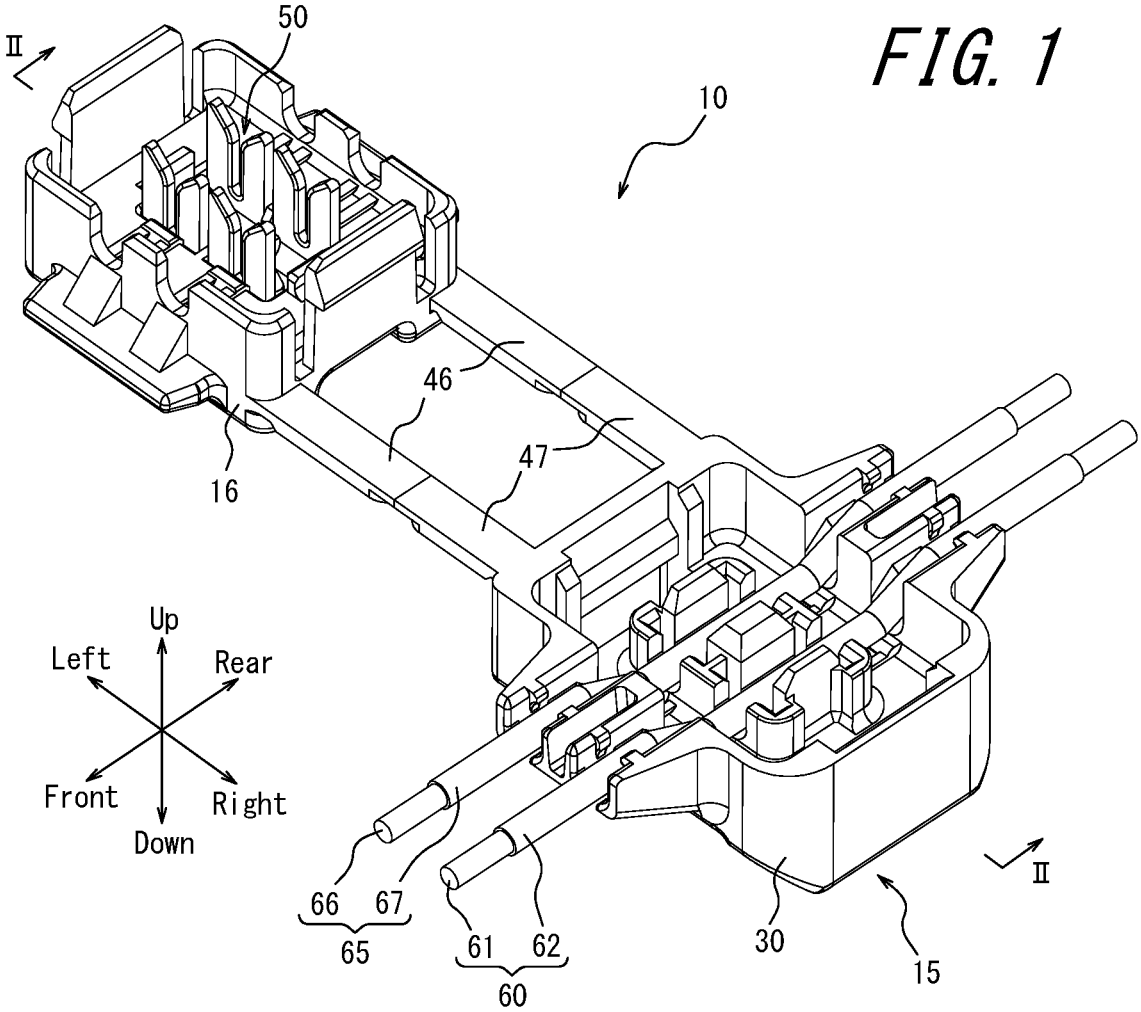
FIG. 1 is a perspective view illustrating a connector, a first cable and a second cable according to an embodiment of the present disclosure when an insulating housing is in an extended state.
Figure 2:
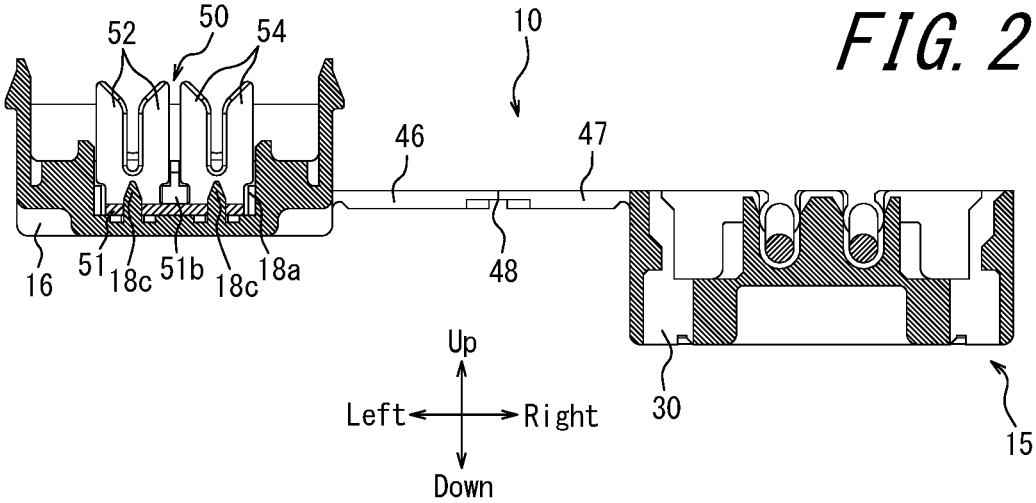
FIG. 2 is a cross-sectional view taken along arrows II-II of FIG. 1.

FIG. 1 is a perspective view of the connector 10, a first cable 60 and a second cable 65 when an insulating housing 15 is in an extended state. FIG. 2 is a cross-sectional view taken along arrows II-II of FIG. 1. The connector 10 according to this embodiment includes the insulating housing 15 and a relay contact 50 (contact) as main elements.

The insulating housing 15 is obtained by, for example, molding a synthetic resin material having insulating properties. The insulating housing 15 includes a first split housing 16 (a first fitting object) and a second split housing 30 (a second fitting object). The insulating housing 15 includes a first connecting portion 46 and a second connecting portion 47 (connecting portions) serving as a coupling portion connecting the first split housing 16 and the second split housing 30. The insulating housing 15 includes the first split housing 16 and the second split housing 30, and the first connecting portion 46 and the second connecting portion 47, in an integrally molded manner.

Figure 3:
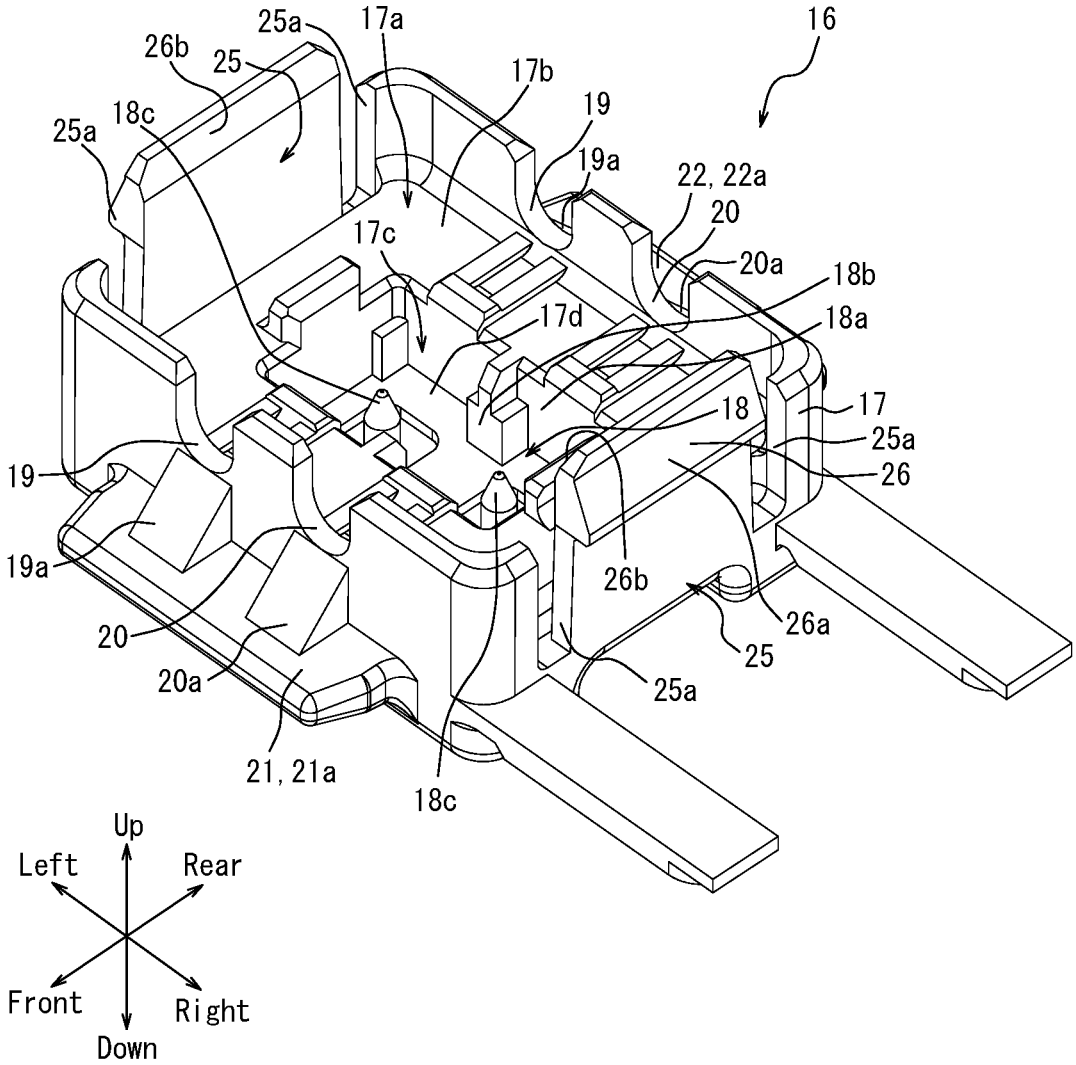
FIG. 3 is an enlarged perspective view illustrating a first split housing alone, omitting a relay contact.

FIG. 3 is an enlarged perspective view illustrating the first split housing 16 alone, omitting the relay contact 50. The configuration of the first split housing 16 will be described in detail with reference to FIG. 3.

An outer peripheral edge of one surface (a top surface in FIG. 3) in a thickness-direction of the first split housing 16 is formed by an outer peripheral wall 17. In the first split housing 16, the inside of the outer peripheral wall 17 is configured as an inner peripheral recess 17*a* recessed stepwise from the top surface of the first split housing 16. The bottom surface of the inner peripheral recess 17*a* includes an inner peripheral first opposing surface 17*b* configured as a plane parallel to the top surface of the first split housing 16. The central portion located on the inner peripheral side of the inner peripheral first opposing surface 17*b* is configured as a first central recess 17*c* recessed stepwise from the inner peripheral first opposing surface 17*b*. The bottom surface of the first central recess 17*c* includes a first central opposing surface 17*d* configured as a plane parallel to the inner peripheral first opposing surface 17*b*. The first central recess 17*c* and the first central opposing surface 17*d* constitute a contact mounting groove 18. The contact mounting groove 18 includes a fixing portion 18*a* and a central projection 18*b*, which is located at the center of the fixing portion 18*a* with respect to the right-left direction and configured to narrow the front-rear direction width of the fixing portion 18*a* while separating the fixing portion 18*a* into a pair of portions in the right-left direction. Each of the bottom surfaces of the fixing portion 18*a* (the first central opposing surface 17*d*) is provided with a positioning protrusion 18*c* having a substantially cylindrical shape.

The outer peripheral wall 17 of the first split housing 16 includes a pair of first cable mounting grooves 19 configured as cutouts linearly arranged on the front and rear sides of one of the fixing portions 18*a*. The outer peripheral wall 17 of the first split housing 16 also includes a pair of second cable mounting grooves 20 configured as cutouts linearly arranged on the front and rear sides of the other fixing portion 18*a*. The second cable mounting groove 20 is in parallel with the first cable mounting groove 19. Each of the first cable mounting grooves 19 and each of the second cable mounting grooves 20 have a semi-circular shape in a plan view. On the front and rear surfaces of the outer peripheral wall 17 of the first split housing 16, a pair of inclined surfaces 19*a* is provided inclining outward in the downward direction from the bottoms of the pair of first cable mounting grooves 19. Similarly, on the front and rear surfaces of the outer peripheral wall 17 of the first split housing 16, a pair of inclined surfaces 20*a* is provided inclining outward in the downward direction from the bottoms of the pair of second cable mounting grooves 20. The front and rear surfaces of the outer peripheral wall 17 of the first split housing 16 are provided with cover portions 21 and 22, respectively. The cover portion 21 has a flat-plate shape extending in the front direction from under the inclined surfaces 19*a* and 20*a*, and the cover portion 22 has a flat-plate shape extending in the rear direction from under the inclined surfaces 19*a* and 20*a*. The opposing surface 21*a* of the cover portion 21 and the opposing surface 22*a* of the cover portion 22 are flush with the bottom of the inclined surfaces 19*a* and 20*a*.

The right and left side surfaces of the outer peripheral wall 17 of the first split housing 16 are provided with a pair of first locking portions 25 having resiliency. A pair of recesses 25*a* is formed between each first locking portion 25 and the front and rear surfaces of the outer peripheral wall 17. Each first locking portion 25 is provided with a first locking protrusion 26 that protrudes outward from the side surface of the first split housing 16. The first locking protrusions 26 extend in the front-rear direction. Each first locking protrusion 26 includes an inclined surface 26*a* that is inclined to the outside of the first split housing 16 in the downward direction. Each of the pair of first locking portions 25 is provided with an inclined surface 26*b* that is formed on the top edge of the inner surface of each of the pair of first locking portions 25 and inclined to the inside of the first split housing 16 in the downward direction.

Figure 4:
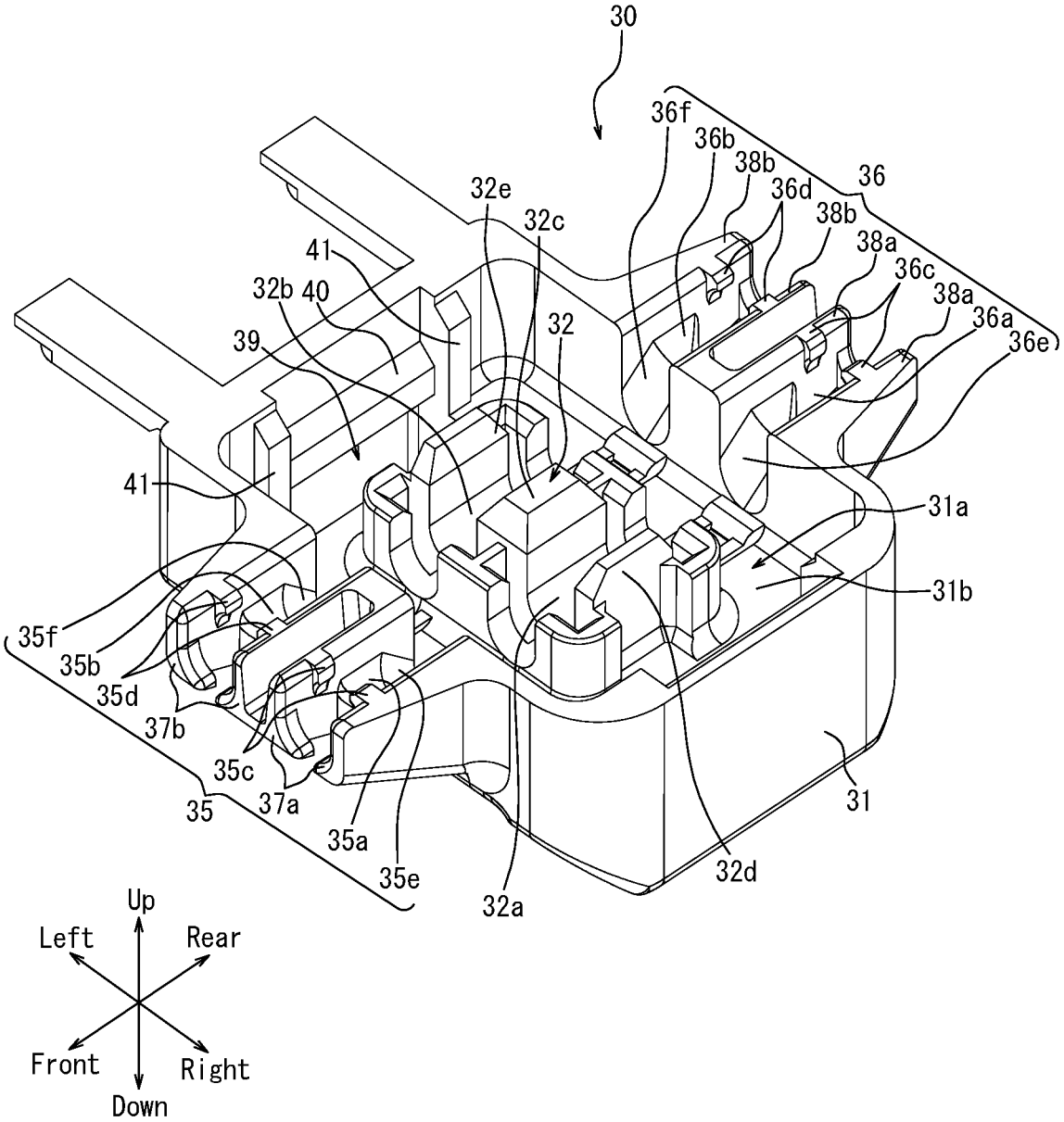
FIG. 4 is an enlarged perspective view illustrating a second split housing alone.

FIG. 4 is an enlarged perspective view of the second split housing 30 alone. The configuration of the second split housing 30 will be described in detail with reference to FIG. 4.

An outer peripheral edge of one surface (a top surface in FIG. 4) in a thickness-direction of the second split housing 30 is formed as a protrusion by an outer peripheral wall 31. In the second split housing 30, the inside of the outer peripheral wall 31 is configured as an inner peripheral recess 31*a* that is recessed stepwise from the top edge of the outer peripheral wall 31. A bottom surface of the inner peripheral recess 31*a* includes an inner peripheral second opposing surface 31*b* configured as a flat plane parallel to the top surface of the second split housing 30. The inner peripheral second opposing surface 31*b* is provided with a cable pressing protrusion 32 that includes a pair of a first pressing groove 32*a* and a second pressing groove 32*b* having U-shapes in cross-sections arranged in the right-left direction. The cable pressing protrusion 32 includes a central protrusion 32*c* and protrusions 32*d* and 32*e* on the right side and the left side, respectively, of the central protrusion 32*c*. The first pressing groove 32*a* is formed between the central protrusion 32*c* and the protrusion 32*d*. The second pressing groove 32*b* is formed between the central protrusion 32*c* and the protrusion 32*e*.

The second split housing 30 includes a cable supporting arm 35 protruding from the front surface of the second split housing 30 and a cable supporting arm 36 protruding from the rear surface thereof. The top surface of the cable supporting arm 35 includes a first cable holding groove 35*a* and a second cable holding groove 35*b*, and the top surface of the cable supporting arm 36 includes a first cable holding groove 36*a* and a second cable holding groove 36*b*. The cable supporting arm 35 located on the front side is provided with a pair of protruding members 37*a* spaced apart from each other in the right-left direction in the front end portion of the first cable holding groove 35*a*, and the cable supporting arm 36 located on the rear side is provided with a pair of protruding members 38*a* spaced apart from each another in the right-left direction in the rear end portion of the first cable holding groove 36*a*. Similarly, the cable supporting arm 35 located on the front side is provided with a pair of protruding members 37*b* spaced apart from each other in the right-left direction in the front end portion of the second cable holding groove 35*b*, and the cable supporting arm 36 located on the rear side is provided with a pair of protruding members 38*b* spaced apart from each other in the right-left direction in the rear end portion of the second cable holding groove 36*b*. Each of the pair of protruding members 37*a*, the pair of protruding members 38*a*, the pair of protruding members 37*b* and the pair of protruding members 38*b*, particularly those located on the right and left outer sides of the cable supporting arms 35 and 36, is elastically bent in the right-left direction and the spacing from its adjacent protrusion is changeable. Each of the pair of protruding members 37*a* and 37*b* includes a pair of claws opposing each other formed at the lower front end. Also, each of the pair of protruding members 38*a* and 38*b* includes a pair of claws opposing each other formed at the lower rear end.

Each of the first cable holding grooves 35*a* and 36*a* and each of the second cable holding grooves 35*b* and 36*b* has a depth sufficient for insertion and retention (to accommodate) of the entire diameter of the first cable 60 and the second cable 65. The first cable holding grooves 35*a* and 36*a* include inclined surfaces 35*e* and 36*e*, respectively, which are inclined upward in the outward directions. That is, when the first cable 60 is inserted into and held by the first cable holding grooves 35*a* and 36*a*, portions of the first cable 60 corresponding to the inclined surface 35*e* of the first cable holding groove 35*a* and the inclined surface 36*e* of the first cable holding groove 36*b* are inclined obliquely in the up-down direction along the inclined surfaces 35*e* and 36*e*, as illustrated in FIG. 1. Similarly, the second cable holding grooves 35*b* and 36*b* include inclined surfaces 35*f* and 36*f*, respectively. The second cable 65 is inserted into and held by the second cable holding grooves 35*b* and 36*b* in a manner similar to the first cable 60.

A pair of retainer protrusions 35*c* is provided to the first cable holding groove 35*a* in the vicinity of a top opening of a front end portion (on the opposing surfaces provided with the pair of protruding members 37*a*) and a pair of retainer protrusions 36*c* is provided to the first cable holding groove 36*a* in the vicinity of a top opening of a rear end portion (on the opposing surfaces provided with the pair of protruding members 38*a*). Similarly, a pair of retainer protrusions 35*d* is provided to the second cable holding groove 35*b* in the vicinity of a top opening of a front end portion (on the opposing surfaces provided with the pair of protruding members 37*b*), and a pair of retainer protrusions 36*d* is provided to the second cable holding groove 36*b* in the vicinity of a top opening of a rear end portion (on the opposing surfaces provided with the pair of protruding members 38*b*). The retainer protrusions 35*c* and 36*c* allow insertion of the first cable 60 into the first cable holding grooves 35*a* and 36*a*, and the retainer protrusions 35*d* and 36*d* allow insertion of the second cable 65 into the second cable holding grooves 35*b* and 36*b*. At the time of the insertion, each of the pair of protruding members 37*a*, the pair of protruding members 38*a*, the pair of protruding members 37*b* and the pair of protruding members 38*b* is bent such that the gaps therebetween (i.e., the gap between the pair of retainer protrusions 35*c*, the gap between the pair of retainer protrusions 36*c*, the gap between the pair of retainer protrusions 35*d*, and the gap between the pair of retainer protrusions 36*d*) are widened in the right-left direction.

When the first cable 60 and the second cable 65 are inserted into the first cable holding grooves 35*a* and 36*a* and the second cable holding grooves 35*b* and 36*b*, respectively, the pair of retainer protrusions 35*c* and the pair of retainer protrusions 36*c* clamp the first cable 60, and the pair of retainer protrusions 35*d* and the pair of retainer protrusions 36*d* clamp the second cable 65. That is, each of the pair of protruding members 37*a*, the pair of protruding members 38*a*, the pair of protruding members 37*b* and the pair of protruding members 38*b* is elastically bent in directions which narrow the space therebetween in the right-left direction. Thus, the pair of protruding members 37*a* and the pair of protruding members 38*a* allow, in a resisting manner, a cable-extending-direction movement of the first cable 60 inserted into the first cable holding grooves 35*a* and 36*a*. Also, the pair of protruding members 37*b* and the pair of protruding members 38*b* allow, in a resisting manner, a cable-extending-direction movement of the second cable 65 inserted into the second cable holding grooves 35*b* and 36*b*. Further, the pair of protruding members 37*a* and the pair of protruding members 38*a* function as a stopper configured to resist a force acting to remove the first cable 60 from the first cable holding grooves 35*a* and 36*a* and inhibit easy removal of the first cable 60, and allow removal of the first cable 60 upon application of an external force of a certain strength or greater. Also, the pair of protruding members 37*b* and the pair of protruding members 38*b* function as a stopper configured to resist a force acting to remove the second cable 65 from the second cable holding grooves 35*b* and 36*b* and inhibit easy removal of the second cable 65, and allow removal of the second cable 65 upon application of an external force of a certain strength or greater. Such retaining actions as described above are maintained even when the second split housing 30 is flipped over (interchange of inside and outside).

The right and left side surfaces of the outer peripheral wall 31 of the second split housing 30 include a pair of second locking portions 39. The pair of second locking portions 39 is formed on the inner surface of the second split housing 30. Each of the pair of second locking portions 39 includes a second locking protrusion 40 that protrudes inward from the side surface of the second split housing 30. Each of the second locking portions 39 includes a pair of projection walls 41 extending in the up-down direction at the front and rear ends of the respective second locking portions 39. Each of the second locking protrusions 40 has a substantially rectangular parallelepiped shape formed on the inner surface of the second split housing 30 and extends between the pair of projection walls 41. That is, the second locking protrusions 40 extend in the front-rear direction.

Figure 5:
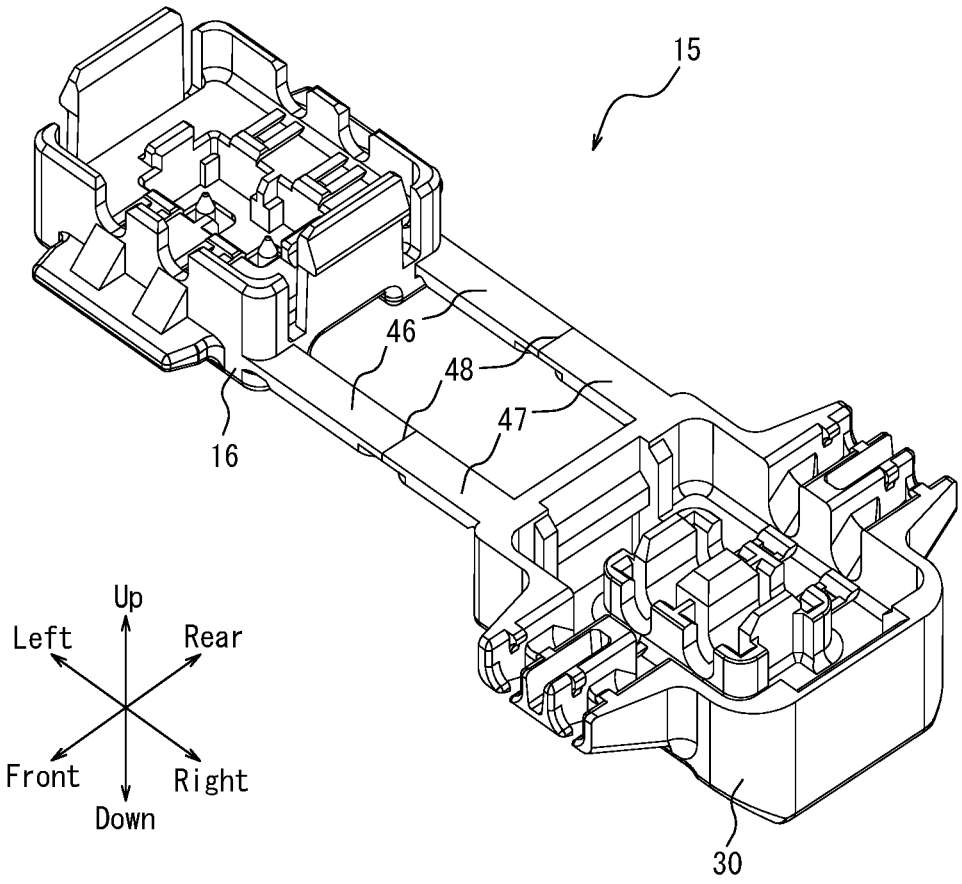
FIG. 5 is a perspective view illustrating the insulating housing in its entirety, omitting the relay contact.

FIG. 5 is a perspective view illustrating the insulating housing 15 in its entirety, omitting the relay contact 50.

The first split housing 16 and the second split housing 30 are coupled via the pair of first connecting portions 46 that is arranged in the front-rear direction and linearly extends from the first split housing 16, a pair of second connecting portions 47 that is arranged in the front-rear direction and linearly extends from the second split housing 30, and a pair of fold-facilitating portions 48. The fold-facilitating portions 48 couple the pair of first connecting portions 46 and the pair of second connecting portions 47. The pair of first connecting portions 46 and the pair of second connecting portions 47 are flushed with each other in the extended state.

The fold-facilitating portions 48 are thinner than the first connecting portion 46 and the second connecting portion 47 arranged in the front-rear direction, as illustrated in FIG. 2 and FIG. 5. Each of the pair of first connecting portions 46 and the pair of second connecting portions 47 arranged in the front-rear direction can be (easily) folded at the fold-facilitating portions 48 that extend in the front-rear direction and serve as a folding line for valley-folding (i.e., in a folding manner to bring the first split housing 16 and the second split housing 30 close to each other) in FIG. 1, FIG. 5, and the like. The pair of first connecting portions 46 has flexural rigidity smaller than that of the pair of second connecting portions 47.

Each of the first split housing 16, the first connecting portions 46, the fold-facilitating portions 48, the second connecting portions 47, and the second split housing 30 has strength (rigidity) sufficient to autonomously maintain the extended state illustrated in FIG. 1 and FIG. 5.

Figure 6:
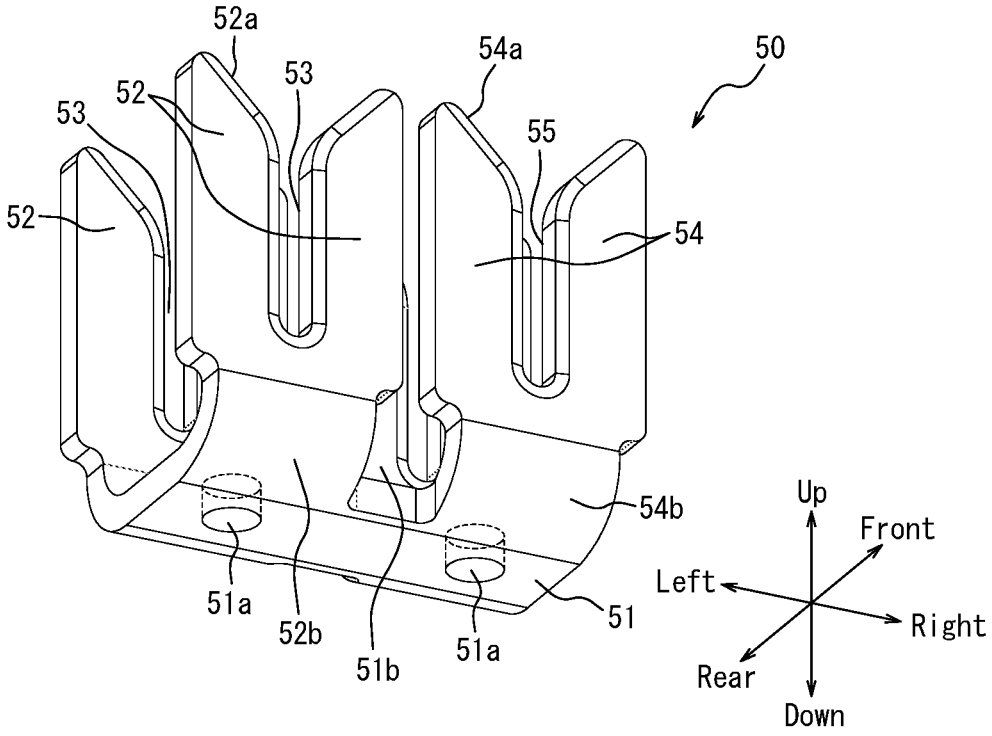
FIG. 6 is a perspective view illustrating the relay contact alone.

FIG. 6 is a perspective view illustrating the relay contact 50 alone. A configuration of the relay contact 50 will be described in detail with reference to FIG. 6.

The relay contact 50 is formed by processing of a thin plate made of a copper alloy (e.g., phosphor bronze, beryllium copper, or titanium copper) or Corson copper alloy into a shape as illustrated in the figure by using a progressive die (stamping). The relay contact 50 is plated with copper-tin alloy or tin (or gold) after nickel plate undercoating.

The relay contact 50 includes, in an integrated manner, a base 51 that has a plate-like shape and extends in the right-left direction, a pair of first cable press-contact members 52 each having a plate-like shape that protrudes from the front and rear edges on one side of the base 51 and extends in a direction perpendicular to the base 51, and a pair of second cable press-contact members 54 each having a plate-like shape that protrudes from the front and rear edges on the other side of the base 51 and extends in a direction perpendicular to the base 51. The base 51 includes a pair of positioning holes 51*a* having a circular shape in the right and left portions of the base 51. Each of the pair of first cable press-contact members 52 and each of the pair of second cable press-contact members 54 arranged in the front-rear direction includes a first press-contact groove 53 and a second press-contact groove 55, respectively, configured as slits linearly extending toward the base 51. Each of the pair of first press-contact grooves 53 includes, at the top opening thereof, a top end portion 52*a* having a substantially V-shape opening upward. Each of the pair of second press-contact grooves 55 includes, at the top opening thereof, a top end portion 54*a* having a substantially V-shape opening upward.

The pair of first cable press-contact members 52 and the pair of second cable press-contact members 54 arranged in the front-rear direction are coupled to the base 51 via narrow portions (neck portions) 52*b* and 54*b*, respectively. The spaces between the opposing edges of the pair of first cable press-contact members 52 and the pair of second cable press-contact members 54 arranged in the right-left direction are narrower than the spaces between the opposing edges of the narrow portions 52*b* and the narrow portions 54*b*. A space 51*b* is formed between the narrow portion 52*b* and the narrow portion 54*b*. No other members, such as an insulator, are provided between the pair of first cable press-contact members 52 and the pair of second cable press-contact members 54.

The relay contact 50 is included with electrically connected with the first cable 60 and the second cable 65 in a state in which the first split housing 16 and the second split housing 30 are fitted together. More specifically, when the first split housing 16 and the second split housing 30 are fitted together, the relay contact 50 cuts insulating sheaths 62 and 67 by a first press-contact groove 53 and a second press-contact groove 55, respectively, to allow the first cable 60 and the second cable 65 to be electrically connected to each other. That is, when fitted together, the relay contact 50 allows the first press-contact groove 53 and the second press-contact groove 55 to clamp a core wire 61 and a core wire 66, respectively, to allow the first cable 60 and the second cable 65 to be electrically connected to each other.

The first cable 60 and the second cable 65 are respectively formed from core wires 61 and 66 (stranded wires or a single wire) made of a material (e.g., copper or aluminum) that has conductivity and flexibility, the core wires are respectively covered by sheaths 62 and 67 formed into a tubular shape and having flexibility and insulating properties. The first cable 60 is a cable originally provided in a wiring object (e.g., an automobile or the like) configured to be connected to a power source of the wiring object. The second cable 65 is a cable additionally connected to the first cable 60. A (front) end of the second cable 65 is connected to an electronic device or an electrical device (e.g., a car navigation system).

Figure 7:
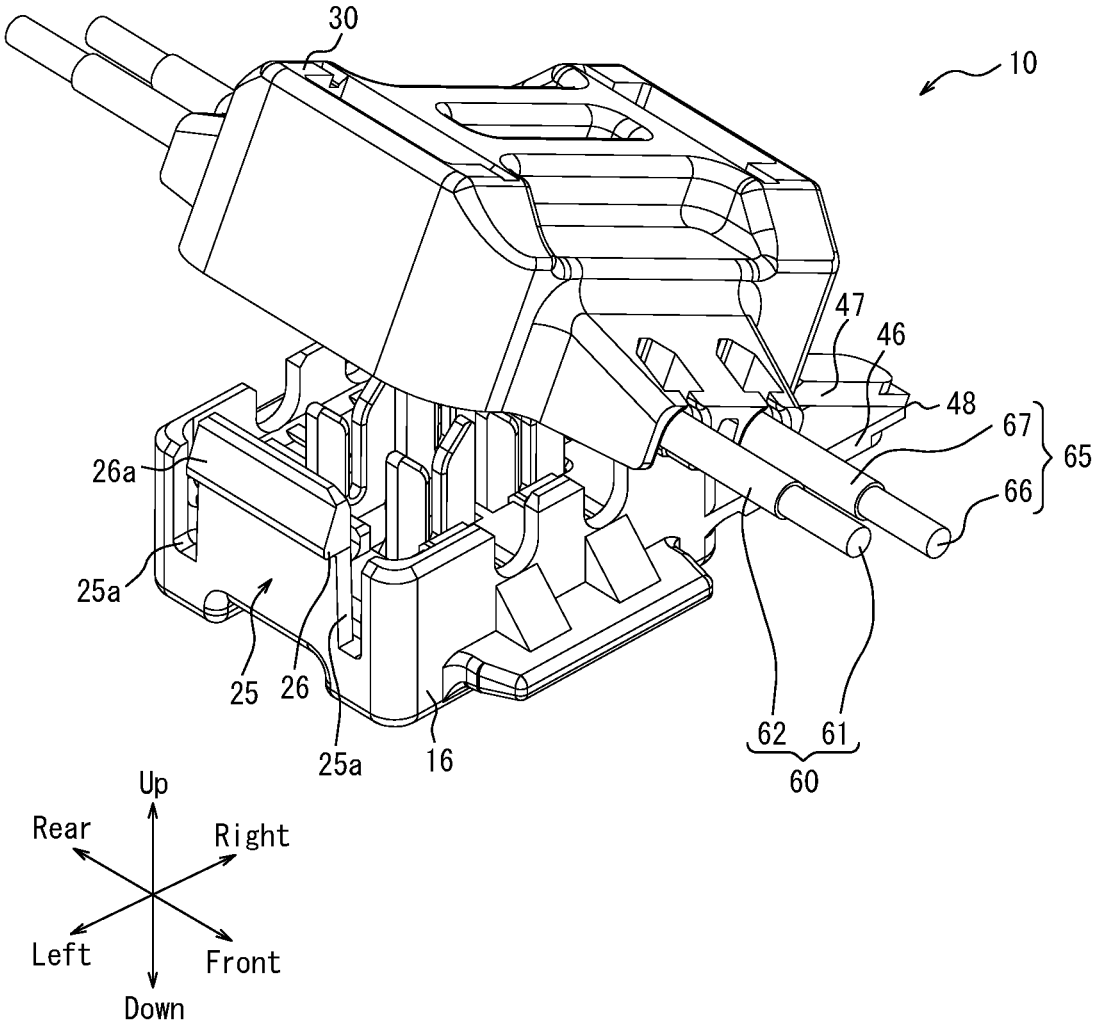
FIG. 7 is a perspective view illustrating the connector, the first cable and the second cable in transition of the insulating housing from the expanded state to a locked state.
Figure 8:
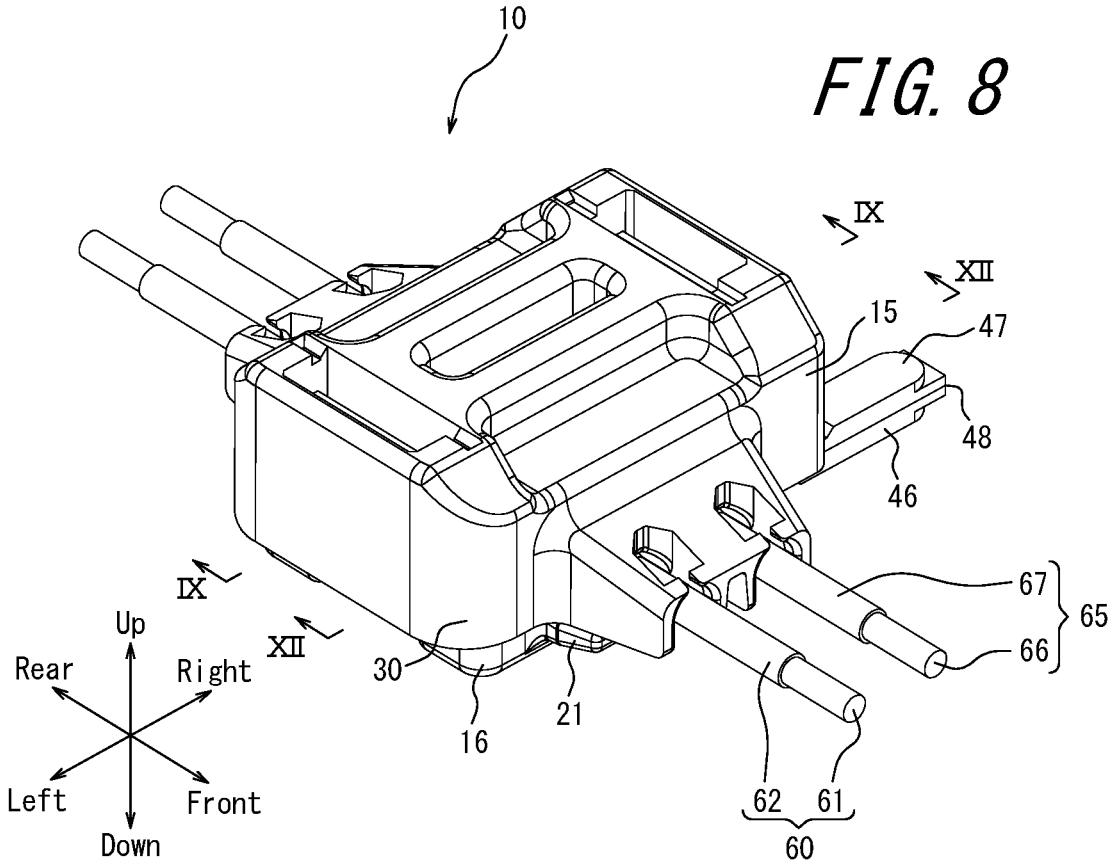
FIG. 8 is a perspective view illustrating the connector, the first cable and the second cable in which the insulating housing is in the locked state.
Figure 9:
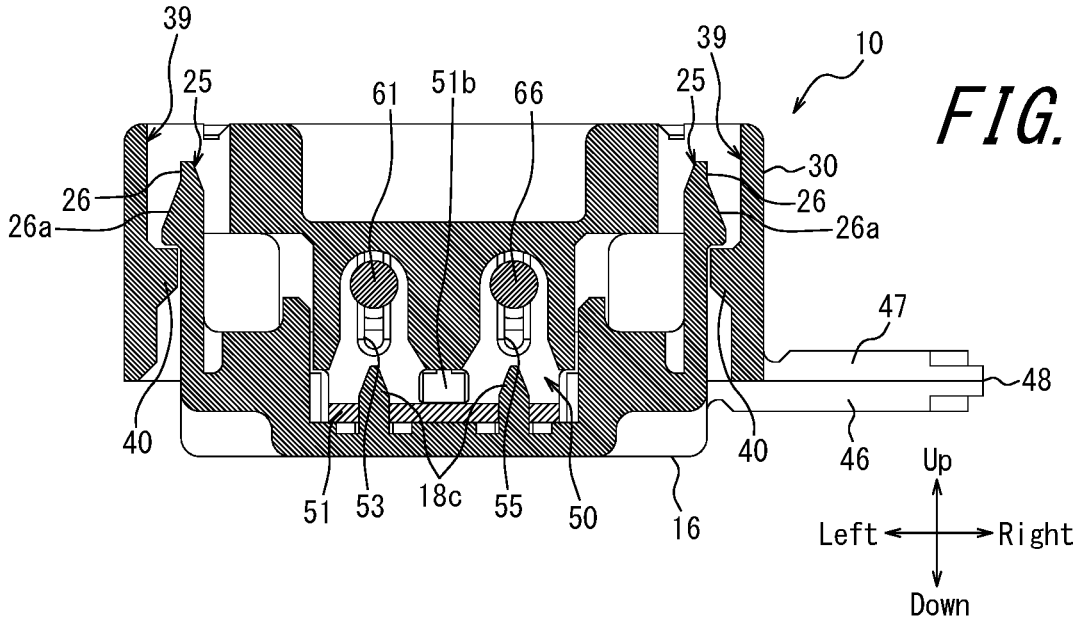
FIG. 9 is a cross-sectional view taken along arrows IX-IX of FIG. 8.

FIG. 7 is a perspective view illustrating the connector 10, the first cable 60 and the second cable 65 in transition of the insulating housing 15 from the extended state to a locked state. FIG. 8 is a perspective view illustrating the connector 10, the first cable 60 and the second cable 65 when the insulating housing 15 is in the locked state. FIG. 9 is a cross-sectional view taken along arrows IX-IX of FIG. 8.

In order to assemble the connector 10 by integrating the insulating housing 15, the relay contact 50, the first cable 60 and the second cable 65 and electrically connecting the first cable 60 and the second cable 65, an assembling operator first manually fits the lower portion of the relay contact 50 into the contact mounting groove 18 of the first split housing 16 in the extended state illustrated in FIG. 1 and FIG. 5. More specifically, the base 51 is fitted to the bottom portion of the contact mounting groove 18 in such a manner that the space 51*b* accommodates the central projection 18*b*. Further, each of the half portions of the first cable press-contact members 52 close to the base 51 (the lower portions in FIG. 1 and FIG. 2) is fitted to a corresponding portion of the fixing portion 18*a*, and each of the half portions of the second cable press-contact members 54 close to the base 51 is fitted to a corresponding portion of the fixing portion 18*a*. Because the pair of positioning protrusions 18*c* of the first split housing 16 is fitted into the pair of positioning holes 51*a* of the base 51 (see FIG. 2 and FIG. 9), the relay contact 50 is positioned relative to the first split housing 16. When the relay contact 50 is mounted in the first split housing 16, the first press-contact grooves 53 arranged in the front-rear direction are located on the axis extending through the pair of first cable mounting grooves 19 arranged in the front-rear direction, and the second press-contact grooves 55 arranged in the front-rear direction are located on the axis extending through the pair of second cable mounting grooves 20 arranged in the front-rear direction.

Subsequently the assembling operator manually pushes the first cable 60 and the second cable 65 in a manner overcoming the resistance of the retainer protrusions 35*c* and 36*c* arranged in the front-rear direction and the retainer projections 35*d* and 36*d* arranged in the front-rear direction, respectively (see FIG. 1). In this case, the pair of protruding members 37*a*, the pair of protruding members 38*a*, the pair of protruding members 37*b* and the pair of protruding members 38*b* are bent against the elastic force in such a manner as to widen the space between the pair of retainer protrusions 35*c*, the space between the pair of retainer protrusions 36*c*, the space between the pair of retainer protrusions 35*d* and the space between the pair of retainer protrusions 36*d*, respectively. When the first cable 60 and second cable 65 are pushed into the first cable holding grooves 35*a* and 36*a* and the second cable holding grooves 35*b* and 36*b*, respectively, the space between the retainer protrusions 35*c*, the space between the retainer protrusions 36*c*, the space between the retainer protrusions 35*d*, and the space between the retainer protrusions 36*d* are narrowed. In this manner, the first cable 60 is clamped between the bottom of the first cable holding grooves 35*a* and 36*a* and the retainer protrusions 35*c* and 36*c*, and the second cable 65 is clamped between the bottom of the second cable holding grooves 35*b* and 36*b* and the retainer protrusions 35*d* and 36*d*. This enables the first cable 60 and the second cable 65 to move in the cable extending direction in a resisting manner. Thus, positions of the first cable 60 and the second cable 65 can be adjusted in the extending directions thereof relative to the connector 10 in the extended state illustrated in FIG. 1 and FIG. 2. Upon application of a force acting to remove the first cable 60 from the first cable holding grooves 35*a* and 36*a* or a force acting to remove the second cable 65 from the second cable holding grooves 35*b* and 36*b*, the corresponding one of first cable 60 and the second cable 65 receives a resisting force inhibiting the removal thereof. Therefore, even when the connector 10 is flipped upside down, the first cable 60 and the second cable 65 do not easily fall out of the first cable holding grooves 35*a* and 36*a* and the second cable holding grooves 35*b* and 36*b*, respectively. The first cable 60 and the second cable 65 can be removed from the first cable holding grooves 35*a* and 36*a* and the second cable holding grooves 35*b* and 36*b*, respectively, upon application of an urging force of a certain strength or greater. This facilitates replacement of the connector 10 and changes of the first cable 60 and the second cable 65 to be mounted in or dismounted from the connector 10.

In a state in which the first cable 60 and the second cable 65 are arranged in the right-left direction and fitted to the first cable holding grooves 35*a* and 36*a* and the second holding grooves 35*b* and 36*b*, respectively, the second split housing 30 (the pair of second connecting portions 47 arranged in the front-rear direction) is rotated toward the first split housing 16 (the pair of first connecting portions 46 arranged in the front-rear direction) in a manner pivoting around the fold-facilitating portions 48 arranged in the front-rear direction. This causes each of the second locking protrusions 40 of the first split housing 16 to contact a corresponding one of the inclined surfaces 26*a* of the first locking protrusions 26. When the second split housing 30 is further rotated, each of the second locking protrusions 40 slides downward on the corresponding one of the inclined surfaces 26*a*, and the first locking protrusion 26 is elastically deformed inward into the first split housing 16. On the other hand, the second pressing groove 32*b* of the cable pressing protrusion 32 located on the side close to the second connecting portion 47 slightly pushes the central portion of the second cable 65 toward the bottom (in the downward direction) of the second press-contact groove 55. This moves the central portion of the second cable 65 into the space between each of the pair of second cable press-contact members 54 arranged in the front-rear direction.

When the assembling operator manually rotates the second split housing 30 further toward the first split housing 16 in a manner pivoting around the fold-facilitating portions 48 arranged in the front-rear direction, the first pressing groove 32*a* of the cable pressing protrusion 32 located on a side remote from the second connecting portions 47 pushes the central portion of the first cable 60 against the top end portions 52*a* of the first cable press-contact members 52 in the extending direction of the first press-contact grooves 53 or in a direction close thereto. In this manner, the first cable 60 is clamped by the top end portions 52*a* and the cable pressing protrusion 32.

After the first cable 60 and the second cable 65 are placed on the top end portion 52*a* and the top end portion 54*a*, respectively, of the relay contact 50, the first split housing 16 and the second split housing 30 are pushed together in substantially parallel directions bringing them close to each other by a generic tool (e.g., pliers), which is not illustrated. Thus, each of the second locking protrusions 40 is engaged with a corresponding one of the first locking protrusions 26, and further, each of the projection walls 41 of the second locking portion 39 is fitted into a corresponding one of the recesses 25*a*. In this manner, the first split housing 16 is accommodated in the second split housing 30, and the first locking portions 25 and the second locking portions 39 are engaged with each other inside the first split housing 16 and the second split housing 30 fitted together.

The cable pressing protrusion 32 further pushes the central portions of the first cable 60 and the second cable 65 deep into (toward the bottoms of) the first press-contact groove 53 and the second press-contact groove 55, respectively. This moves the first cable 60 substantially to the central portions of the first press-contact grooves 53 from the top end portions 52*a*, and the second cable 65 substantially to the central portions of the second press-contact grooves 55 from the top end portions Ma. In this case, the first cable 60 and the second cable 65 are pressed by the first pressing groove 32*a* and the second pressing groove 32*b*, respectively, of the cable pressing protrusion 32 in directions substantially parallel to each other in the up-down direction (i.e., the extending directions of the first press-contact groove 53 and the second press-contact groove 55). Thus, the inner surfaces (right and left surfaces) of the first press-contact groove 53 cut through the right and left side portions of the sheath 62 of the first cable 60, and the inner surfaces (right and left surfaces) of the second press-contact grooves 55 cut through the right and left side portions of the sheath 67 of the second cable 65. In this manner, when the insulating housing 15 is held in a closed state, the inner surfaces (a pair of surfaces opposing each other) of the first press-contact grooves 53 evenly and reliably contact (press contact) both side portions of the core wire 61. Also, the inner surfaces (a pair of surfaces opposing each other) of the second press-contact grooves 55 evenly and reliably contact (press contact) both side portions of the core wire 66. That is, the core wire 61 of the first cable 60 and the core wire 66 of the second cable 65 are electrically connected to each other via the relay contact 50 in the connector 10.

Because the side portions of the core wire 61 and the side portions of the core wire 66 are not clamped in an excessively strong manner by the inner surfaces of the first press-contact grooves 53 and the inner surfaces of the second press-contact grooves 55, parts of the core wire 61 and the core wire 66 are not cut by the first press-contact grooves 53 and the second press-contact grooves 55, respectively. Thus, the core wires 61 and 66 maintain the respective mechanical strengths, thereby reducing the likelihood that the core wires 61 and 66 are completely severed by tensile forces applied to the first cable 60 and the second cable 65. This can improve reliable contact between each of the first cable 60 and the second cable 65 and the relay contact 50.

In a state in which the first split housing 16 and the second split housing 30 are closed (fitted together) and held (locked), the opposing surface 21*a* of the cover portion 21 of the first split housing 16 partially closes the openings (the top openings in FIG. 4) of the first cable holding groove 35*a* and the second cable holding groove 35*b*, and the opposing surface 22*a* of the cover portion 22 of the first split housing 16 partially closes the openings of the first cable holding groove 36*a* and the second cable holding groove 36*b*. Furthermore, the first cable 60 is clamped in the up-down direction by the pair of inclined surfaces 19*a* of the first split housing 16 and the corresponding inclined surfaces 35*e* and 36*e* of the second split housing 30. The second cable 65 is clamped in the up-down direction by the pair of inclined surfaces 20*a* of the first split housing 16 and the corresponding inclined surfaces 35*f* and 36*f* of the second split housing 30.

The connector 10 in a state loaded with fillers 70 will be mainly described below. The fillers 70 (a first filler 70*a* and a second filler 70*b*) are provided in the first split housing 16 and the second split housing 30, respectively. The first filler 70*a* and the second filler 70*b* are crushed and integrated to each other when the first split housing 16 and the second split housing 30 are fitted together. The fillers 70 may be any material having merging properties such as waterproof gels, UV curable resins, adhesives and the like. In particular, the fillers 70 may preferably be composed of UV curable resin that effectively exhibits a waterproof function. More specifically, the fillers 70 are composed of a material mainly comprising urethane acrylate, epoxy acrylate, acrylic resin acrylate, polyester acrylate, polybutadiene acrylate, silicon acrylate, amino resin acrylate, urethane vinyl ether, polyester vinyl ether, silicone elastomer, styrene elastomer, or polyethylene polystyrene elastomer or the like. In particular, the fillers 70 may preferably be composed of a material mainly comprising urethane acrylate that has merging properties, resiliency and heat resistance together.

Figure 10:
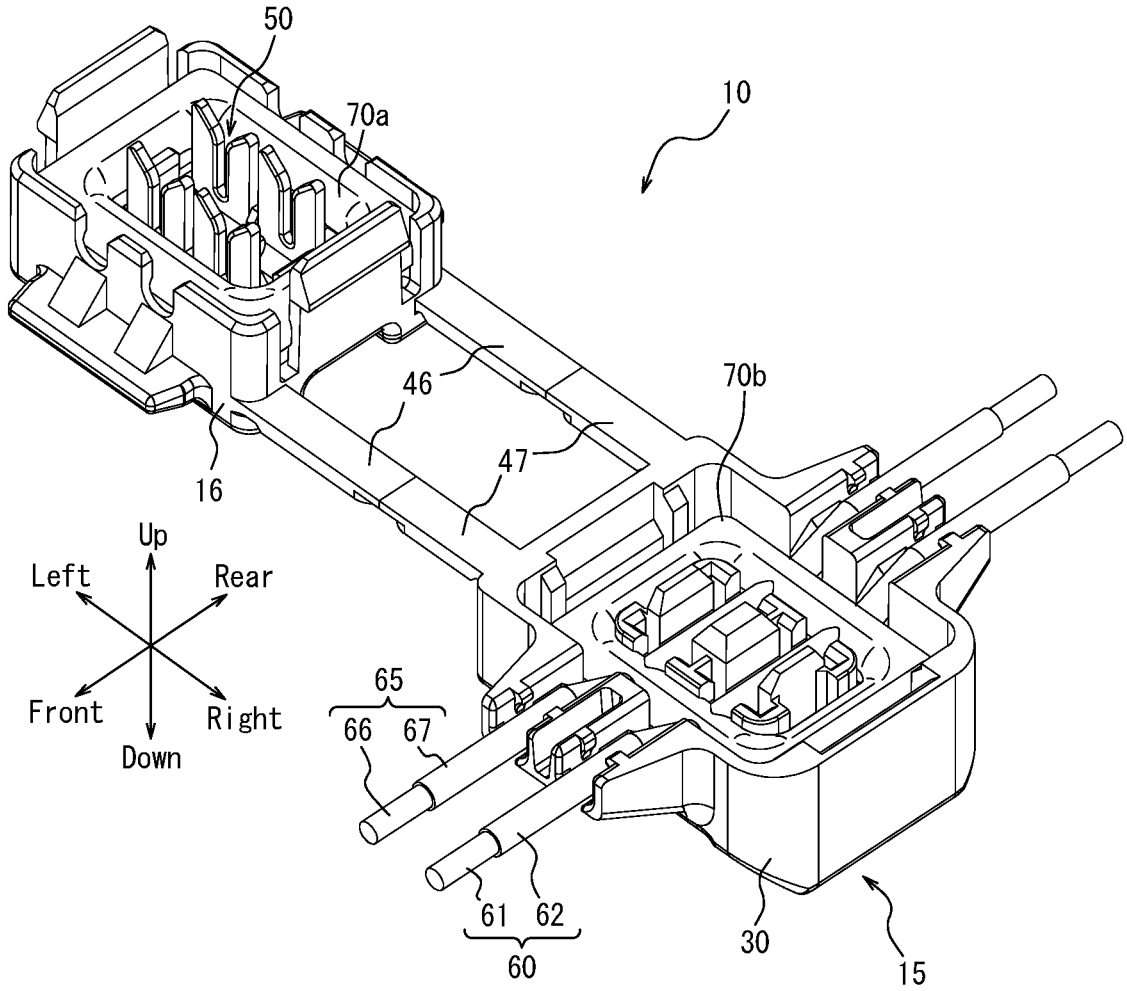
FIG. 10 is a perspective view of the insulating housing loaded with fillers in the expanded state.
Figure 11:
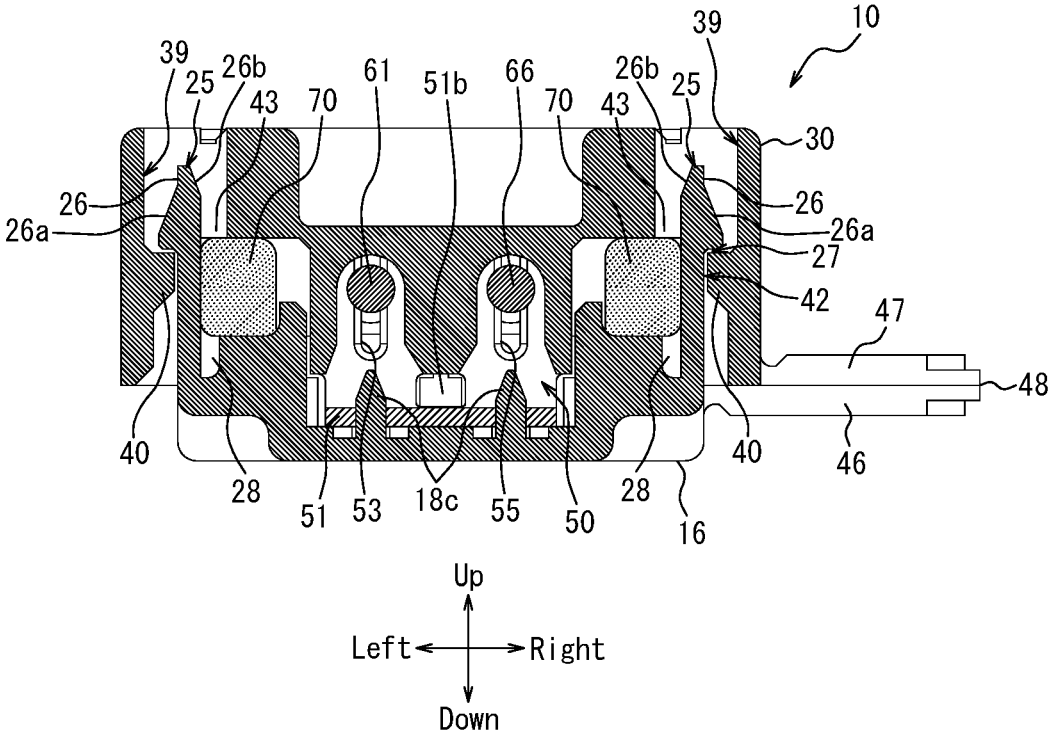
FIG. 11 is a cross-sectional view, corresponding to FIG. 9, illustrating the connector loaded with fillers in the locked state.
Figure 12:
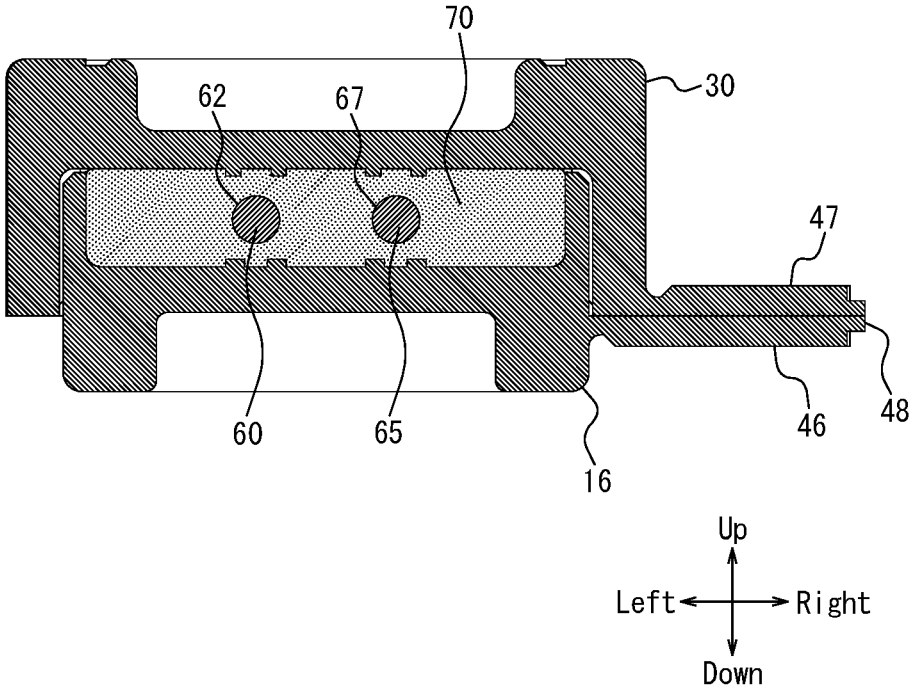
FIG. 12 is a cross-sectional view illustrating the connector loaded with fillers in the locked state taken along arrows XII-XII of FIG. 8.
Figure 13:
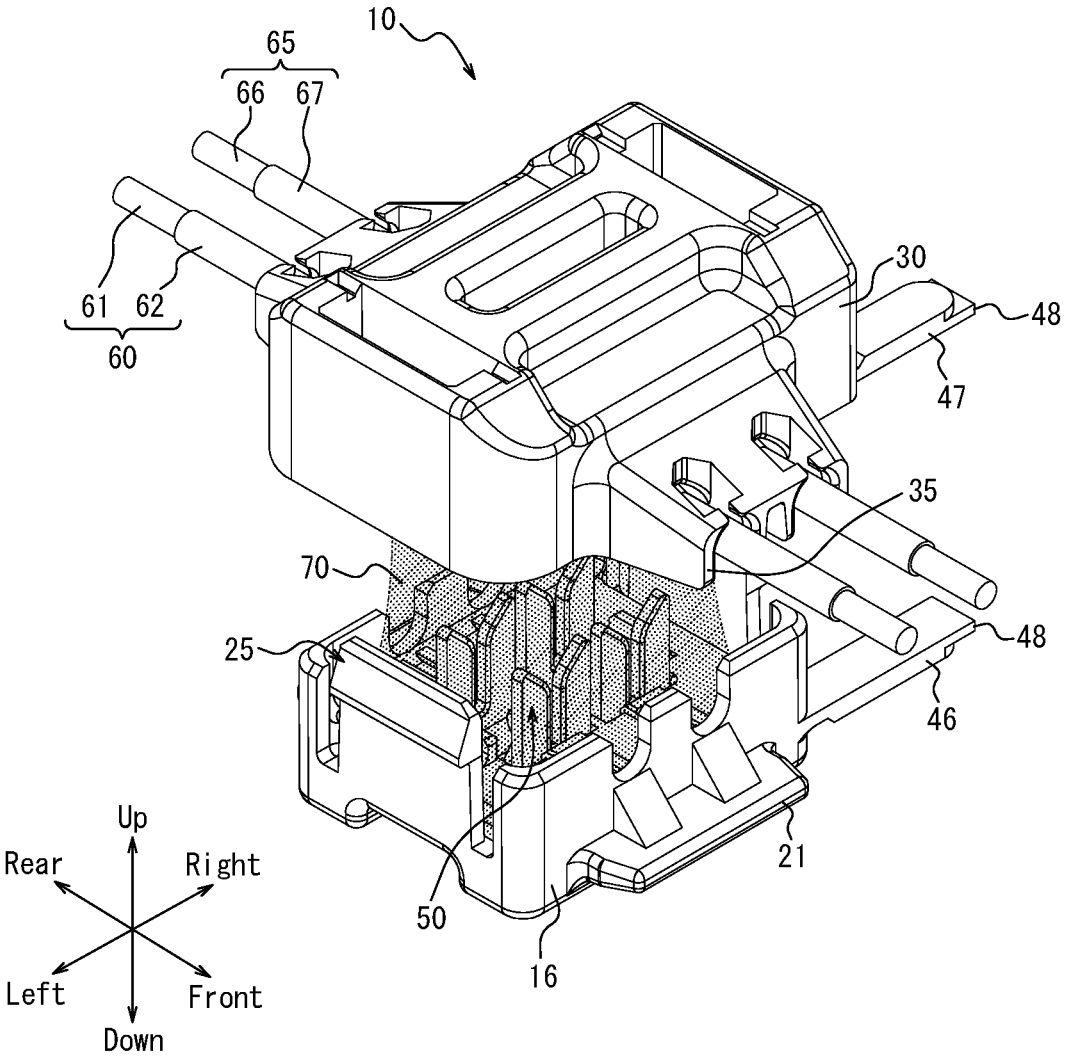
FIG. 13 is a perspective view virtually illustrating integrated fillers in the extended state.

FIG. 10 is a perspective view illustrating the insulating housing 15 loaded with the fillers 70 in the extended state. FIG. 11 is a cross-sectional view illustrating the connector 10 loaded with the fillers 70 in the locked state corresponding to FIG. 9. FIG. 12 is a cross-sectional view illustrating the connector 10 loaded with the fillers 70 in the locked state taken along arrows XII-XII of FIG. 8. FIG. 13 is a perspective view virtually illustrating the fillers 70 integrated to each other in the extended state.

In an embodiment, the fillers 70 are placed on the inner peripheral first opposing surface 17*b* of the first split housing 16 and the inner peripheral second opposing surface 31*b* of the second split housing 30, respectively, as illustrated in FIG. 10.

The first filler 70*a* placed on the inner peripheral first opposing surface 17*b* of the first split housing 16 includes a bottom surface having a planar shape in substantial conformance with the inner peripheral first opposing surface 17*b*, and has a rectangular tubular shape surrounding the relay contact 50. The height of the first filler 70*a* is determined such that the first filler 70*a* and the second filler 70*b* are crushed and integrated to each other when the first split housing 16 and the second split housing 30 are fitted together.

The second filler 70*b* placed on the inner peripheral second opposing surface 31*b* of the second split housing 30 includes a bottom surface having a planar shape in substantial conformance with the inner peripheral second opposing surface 31*b*, and has a rectangular tubular shape surrounding the cable pressing protrusion 32. The height of the second filler 70*b* is determined such that the first filler 70*a* and the second filler 70*b* are crushed and integrated to each other when the first split housing 16 and the second split housing 30 are fitted together.

That is, when the first split housing 16 and the second split housing 30 are fitted together, the first filler 70*a* and the second filler 70*b* are needed to be overlapped one another by a predetermined thickness along the up-down direction to obtain a compressed state described below. In other words, the height obtained by adding the height of the first filler 70*a* to the height of the second filler 70*b* before the first split housing 16 and the second split housing 30 are fitted together is a little bit higher than the height of the first filler 70*a* and the second filler 70*b* to be crushed and integrated to each other when the first split housing 16 and the second split housing 30 are fitted together. Therefore, before the first split housing 16 and the second split housing 30 are fitted together, a merging surface formed by the top surface of the first filler 70*a* is located further on the fitted side (upper side) than the merging surface of the first filler 70*a* in a compressed state immediately before the fillers are crushed and integrated to each other. Similarly, before the first split housing 16 and the second split housing 30 are fitted together, a merging surface formed by the top surface of the second filler 70*b* is located further on the fitted side (upper side) than the merging surface of the second filler 70*b* in a virtual compressed state immediately before the fillers are crushed and integrated to each other. In this case, assuming that a merging surface between the first filler 70*a* and the second filler 70*b* in a compressed state immediately before the fillers are crushed and integrated to each other is a central surface of fitting, the merging surface of the first filler 70*a* before the first split housing 16 and the second split housing 30 are fitted together is located further on the fitted side (upper side) than the central surface of fitting. Similarly, the merging surface of the second filler 70*b* before the first split housing 16 and the second split housing 30 are fitted together is located further on the fitted side (upper side) than a plane corresponding to the central surface of fitting.

When the connector 10 is transitioned to the locked state from the extended state illustrated in FIG. 10, the entire interior of the first split housing 16 and the entire interior of the second split housing 30 fitted together is loaded with the fillers 70 as illustrated in FIG. 11. More specifically, when the first split housing 16 and the second split housing 30 are brought into the locked state, the fillers 70 closely contact the inner peripheral first opposing surface 17*b* and the inner peripheral second opposing surface 31*b* and thus surround the relay contact 50. In this case, the first filler 70*a* and the second filler 70*b* are crushed to each other and are brought into a compressed state once, and they are integrated through a chemical reaction such as hydrogen bonding. That is, unlike the case where materials such as a normal Si gel having adhesive properties are bonded together, no bonding surface is formed to fillers 70 that are crushed and integrated to each other. In this manner, the fillers 70 seal around the relay contact 50.

In the locked state, the first cable 60 and the second cable 65 extend outward from the relay contact 50 arranged inside of the fillers 70 in the locked state. That is, the first cable 60 and the second cable 65 extend outward from the press-contact portion of the relay contact 50 along the front-rear direction.

Furthermore, the fillers 70 surround the surface of the sheath 62 of the first cable 60 and the surface of the sheath 67 of the second cable 65 (without interrupting electrical connection with the relay contact 50). More specifically, as illustrated in FIG. 12, when the first split housing 16 and the second split housing 30 are fitted together, the first cable 60 and the second cable 65 are arranged, respectively, in the insides of the first filler 70*a* and the second filler 70*b* integrated to each other, in a cross-sectional view along the fitting direction, that is, the up-down direction. In other words, the fillers 70 that are crushed and integrated to each other have no bonding surface, and thus the corresponding portions of the first cable 60 and the second cable 65 are completely included in the fillers 70. In this manner, unlike the case where materials having adhesive properties such as normal Si gel are bonded to each other, almost no gap is formed between the surface of the sheath 62 and the filler 70 and between the surface of the sheath 67 and the filler 70.

For example, as virtually illustrated in FIG. 13, even if the first split housing 16 and the second split housing 30 are separated along the up-down direction, when the first filler 70*a* and the second filler 70*b* are crushed and integrated to each other once, they never separate from each other. That is, the first filler 70*a* and the second filler 70*b* that are crushed and integrated to each other have no bonding surface, thus no event in which a bonding surface is peeled off occurs. Even if the first split housing 16 and the second split housing 30 are caused to be separated along the up-down direction, the first filler 70*a* and second filler 70*b* that are crushed and integrated to each other continue sealing around the relay contact 50 while integrally extending. When the fillers 70 have both merging properties and resiliency, they expand and contract to some extent due to vibration of the connector 10. Even in this case, the first filler 70*a* and second filler 70*b* that are crushed and integrated to each other expand and contract homogeneously while being integrated to each other. That is, the distribution of stress acting on the first filler 70*a* and second filler 70*b* that are crushed and integrated to each other is approximately homogeneous all over the fillers.

In this manner, unlike the case where the conventional materials having adhesive properties are bonded to each other, when the first filler 70*a* and the second filler 70*b* are crushed and integrated to each other once, an event may not occur in which they separate from each other due to peeling off of the bonding surface caused by mechanical action or thermal expansion.

The first split housing 16 and the second split housing 30 include a pair of spaces 28 and a pair of spaces 43, respectively, for accommodating excessive portions of the fillers 70 (FIG. 11). In a state in which the first split housing 16 and the second split housing 30 are fitted together, the spaces 28 and the spaces 43 are formed along the inner surfaces of the pair of first locking portions 25, and the spaces 28 are located under the fillers 70 while the spaces 43 are located above the fillers 70. In this manner, the spaces 28 and the spaces 43 can absorb and store the excessive portions of the fillers 70 in the locked state. Consequently, the connector 10 can accommodate a difference between pressing forces applied to the first cable 60 and the second cable 65.

The fillers 70 abut the inner surfaces of the pair of first locking portions 25 of the first split housing 16. Each of the engaging surfaces 27 of the first locking protrusion 26 and the second locking protrusion 40 may preferably be located, with respect to the up-down direction thereof, within the up-down direction width of the fillers 70, as illustrated in FIG. 11. Furthermore, when the first split housing 16 and the second split housing 30 are fitted together, the surface of the second locking protrusion 40 abuts the outer surface of the first locking portion 25. Each of abutment surfaces 42 thus formed may preferably be substantially parallel to the inner surface of the first locking portion 25 abutting each filler 70.

With the fillers 70 configured in the above described manner, the connector 10 can effectively prevent foreign matter such as water or dust from entering from outside. In particular, because the fillers 70 that are crushed and integrated to each other surround the relay contact 50, the likelihood that the foreign matter may contact the core wires 61 and 62 of the first cable 60 and the core wires 66 and 67 of the second cable 65 can be reduced. In particular, because corresponding portions of the first cable 60 and the second cable 65 are arranged in the fillers 70 with almost no gap formed between the surface of the sheath 62 and the filler 70 and between the surface of the sheath 67 and the filler 70, the connector 10 has an excellent waterproof properties. In this manner, the connector 10 can improve waterproof properties even if it holds the first cable 60 and the second cable 65, and thus can effectively prevent other foreign matters from entering from outside.

The first filler 70*a* and the second filler 70*b* are crushed and integrated to each other. Thus, compared with the case where the conventional materials having adhesive properties are bonded to each other, a binding force will be significantly increased. In other words, the bonding surface between the first filler 70*a* and the second filler 70*b* disappears, and thus peeling off of a bonding surface may not occur. Therefore, the connector 10 can significantly increase a resistance against a force acting to cause the first filler 70*a* and the second filler 70*b* to be separated from each other.

Because the bonding surface disappears, unlike the case where the conventional materials having adhesive properties are bonded to each other, an event in which water enters from a small gap formed in a portion of the bonding surface due to a decreased adhesive power may not occur in the connector 10. That is, the connector 10 can effectively protect the contact portion between the relay contact 50 and each of core wires 61 and 66 against the hydraulic pressure applied over the fillers 70. In this manner, the connector 10 contributes to an improvement of waterproof properties.

Although a relatively large pressure was needed to be applied to maintain bonding between materials having adhesive properties in the past, according to the connector 10, it is not necessary to apply a large pressure because a bonding surface disappears and the fillers can be integrated to each other. That is, the connector 10 can obtain sufficient waterproof properties without increasing, more than necessary, a force to hold fitting between the first split housing 16 and the second split housing 30.

Because the first filler 70*a* and the second filler 70*b* that are crushed and integrated to each other expand and contract homogeneously while being integrated to each other, they are not separated by mechanical action or thermal expansion. In this manner, the connector 10 can maintain waterproof properties. For example, under high-vibration or high-temperature environment, an event may occur in which a pressure of a bonding surface between materials having adhesive properties may decrease or the bonding surface may be peeled off, which causes a decrease in waterproof properties. However, the connector 10 can eliminate such event. The connector 10 can maintain sufficient waterproof properties even under high-vibration or high-temperature environment.

By using a material composed mainly of urethane acrylate as fillers 70 of the connector 10, an optimal waterproof member that simultaneously has merging properties, resiliency and heat resistance properties can be provided. In this manner, the connector 10 can significantly exhibit a variety of above described effects.

Because the fillers 70 closely contact the first cable 60 and the second cable 65, even if the first cable 60 and the second cable 65 are shaken and bent by an external force applied to the outside of the connector 10, transmission of action or stress caused by the bent of the first cable 60 and the second cable 65 to the press-contact portion with the relay contact 50 can be prevented. Consequently reliable contact can be maintained.

When the filler 70 abuts the inner surfaces of the pair of first locking portions 25, the first locking portions 25 having resiliency are elastically deformed outward by an elastic force acting from the inside to the outside caused by the expansion or swelling of the filler 70. Because the connector 10 includes the locking portions formed therein, the connector 10 enables stronger engagement between the first locking portion 25 and the second locking portion 39 by their outward elastic deformation. More specifically, because the engaging surfaces 27 of the first locking protrusions 26 and the second locking protrusions 40 are located within the up-down-direction width of the inner surface of the first locking portion 25 abutting the filler 70, an expansion force or the like of the fillers 70 is efficiently converted into an engaging force. Further, when the abutment surfaces 42 are substantially parallel to the inner surfaces of the pair of first locking portions 25 abutting the fillers 70, the expansion forces and the like of the fillers 70 are transmitted to the surfaces of the first locking portion 25 and the second locking protrusion 40 in a direction substantially perpendicular thereto. This enables further efficient conversion of the expansion force or the like of the filler 70 into an engaging force. Consequently, the connector 10 can further strengthen the close contact between the first split housing 16 and the second split housing 30. In this manner, even in a state in which an elastic force acts from the inside to the outside, the connector 10 can inhibit opening of the first split housing 16 and the second split housing 30. Consequently, the connector 10 can maintain the waterproof properties. Although the above described effect is demonstrated at a room temperature, the effect becomes more noticeable when expansion of the filler 70 is increased at high temperature.

When the fillers 70 have also high viscosity, the connector 10 can further suppress the opening between the first split housing 16 and the second split housing 30. That is, when the fillers 70 are loaded to each of inner surfaces of the first split housing 16 and the second split housing 30, the fillers 70 stick to each other in the locked state. This adhesive force acts as a force resisting against the opening of the first split housing 16 and the second split housing 30 fitted together.

Because the connector 10 includes the locking mechanism inside the first split housing 16 and the second split housing 30 fitted together, the outer peripheral wall 31 can be formed in a substantially planar shape with less unevenness or through holes. This enables the connector 10 to have improved waterproof properties and to prevent other foreign matters such as dust and oil from entering from outside.

When the pair of first locking protrusions 26 extending in one direction and the pair of second locking protrusions 40 extending in the same direction are engaged with each other, and the engaging surfaces 27 form flat surfaces extending in the same direction, the connector 10 can increase an area of the engaging surfaces 27 and thus strengthen the engagement. Because the engaging surfaces 27 in the connector 10 are substantially horizontal as illustrated in FIG. 11, the engaging force can be easily transmitted between the first locking protrusion 26 and the second locking protrusion 40. In this manner, the first locking protrusion 26 and the second locking protrusion 40 of the connector 10 can have larger widths than those of conventional locking portions formed externally. This further increases a locking force and strengthens the locking. Because the strengths of the first locking portion 25 and the second locking portion 39 themselves are also increased, the connector 10 can inhibit damages to the locking portions.

Because the first locking portion 25 includes the inclined surface 26*b*, the connector 10 can prevent the top end of the first locking portion 25 from being pushed into or scraping the fillers 70 when the first split housing 16 and the second split housing 30 are fitted together.

It will be apparent to those skilled in the art that the present disclosure may be realized in forms other than the embodiment described above, without departing from the spirit and the fundamental characteristics of the disclosure. Accordingly, the foregoing description is merely illustrative and not limiting in any manner. The scope of the present disclosure is defined by the appended claims, not by the foregoing description. Among all modifications, those within a range of the equivalent to the present disclosure shall be considered as being included in the present disclosure.

Figure 14:
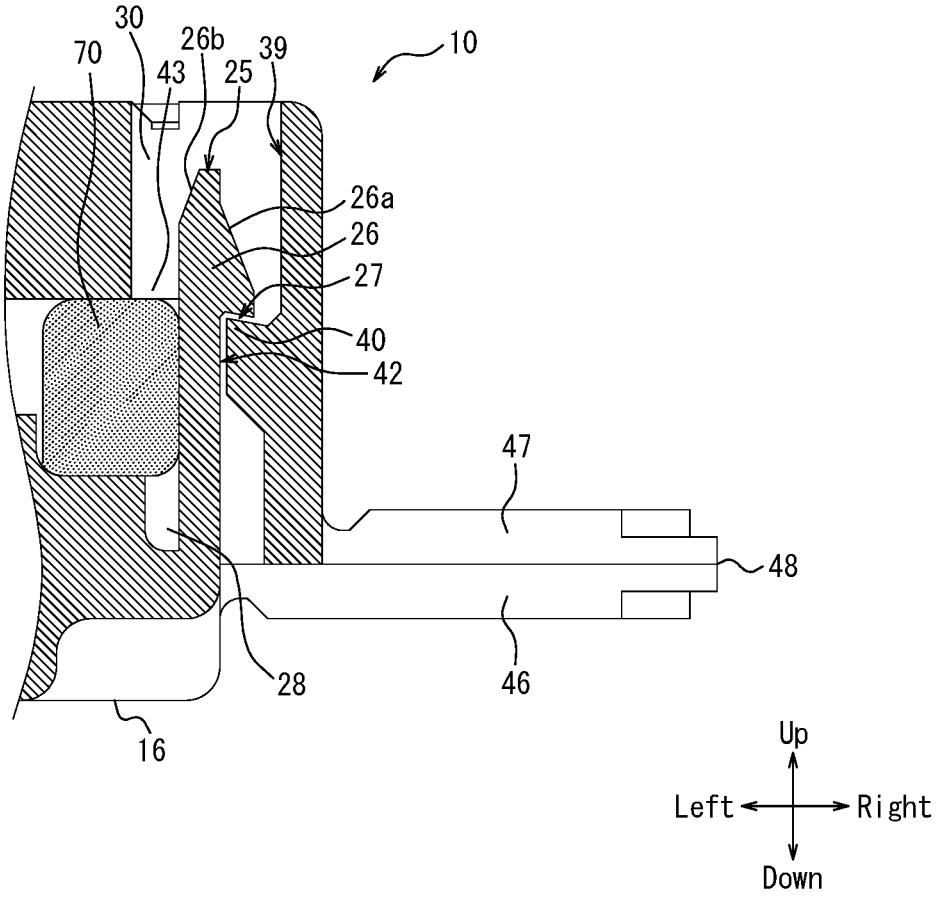
FIG. 14 is an enlarged cross-sectional view, corresponding to FIG. 11, of an engaging portion of a first locking portion and a second locking portion according to a variation example.

FIG. 14 is an enlarged cross-sectional view illustrating an engaging portion between the first locking portion 25 and the second locking portion 39 corresponding to FIG. 11 according to a variation. In the above embodiment, each of the engaging surfaces 27 between the first locking protrusion 26 and the second locking protrusion 40 is a horizontal flat surface extending in the front-rear direction, as illustrated in FIG. 11. However, this is not restrictive. For example, each of the engaging surfaces 27 may be inclined downward toward the outside from the inside of the first split housing 16 and the second split housing 30 fitted together, as illustrated in FIG. 14. This cross-sectional shape of the connector 10 can further reduce the likelihood of disengagement.

In the embodiment, although the first locking portions 25 are formed in the first split housing 16 and the second locking portions 39 are formed in the second split housing 30, this is not restrictive. The first locking portions 25 having resiliency may be formed in the second split housing 30 that does not include the relay contacts 50, and the second locking portions 39 may be formed in the first split housing 16 that includes the relay contact 50. Further, the respective positions of the first locking portions 25 and the second locking portions 39 in the first split housing 16 and the second split housing 30 are not limited to the above description. The first locking portions 25 and the second locking portions 39 may be formed in any position as long as the first split housing 16 and the second split housing 30 can be fitted together and the locked state can be secured.

In the embodiment, the first locking portions 25 and the second locking portions 39 include the first locking protrusions 26 and the second locking protrusions 40, respectively, which engage with each other and function as locking means. However, this is not restrictive. The first locking portions 25 and the second locking portions 39 may have any locking means.

In the embodiment, although the pair of retainer protrusions 35*c* and the pair of retainer protrusions 36*c* configured to prevent the first cable 60 from coming off are provided to the first cable holding grooves 35*a* and 36*a*, respectively, and the pair of retainer protrusions 35*d* and the pair of retainer protrusions 36*d* configured to prevent the second cable 65 from coming off are provided to the second cable holding grooves 35*b* and 36*b*, respectively, the retainer protrusions may be provided to each of the first pressing groove 32*a* and the second pressing groove 32*b* of the cable pressing protrusion 32.

Although the relay contact 50 is configured to clamp the second cable 65, the relay contact 50 may be configured to crimp the second cable 65. In this case, the second cable 65 is connected in a crimped manner to the relay contact 50 in advance and, in this state, the relay contact 50 is mounted in the first split housing 16. In this embodiment, cable crimp terminals are formed in place of one of the pair of first press-contact grooves 53 and the pair of second press-contact grooves 55 of the relay contact 50. The second split housing 30 is provided with the cable supporting arm 35 or 36 corresponding to the remaining one of the press-contact grooves.

On the contrary, the connector 10 may connect three or more cables together that are arranged in a direction orthogonal to or substantially orthogonal to the extending direction of the portions of the cables supported by the connector 10. In this case, a relay contact may include a set of three or more press-contact grooves (arranged in the right-left direction). Further, a plurality of relay contacts may include the respective press-contact grooves, and at least one of the relay contacts includes two or more pairs of press-contact grooves, each of which is configured to clamp a cable (a core wire).

In the above description, the first split housing 16 corresponds to the first fitting object and the second split housing 30 corresponds to the second fitting object. However, this is not restrictive, and the relationship may be opposite.

REFERENCE SIGNS LIST

10 Connector
15 Insulating housing
16 First split housing (first fitting object)
17 Outer peripheral wall
17*a* Inner peripheral recess
17*b* Inner peripheral first opposing surface
17*c* First central recess
17*d* First central opposing surface
18 Contact mounting groove
18*a* Fixing portion
18*b* Central projection
18*c* Positioning protrusion
19 First cable mounting groove
19*a* Inclined surface
20 Second cable mounting groove
20*a* Inclined surface
21, 22 Cover portion
21*a*, 22*a* Opposing surface
25 First locking portion
25*a* Recess
26 First locking protrusion
26*a*, 26*b* Inclined surface
27 Engaging surface
28 Space
30 Second split housing (second fitting object)
31 Outer peripheral wall
31*a* Inner peripheral recess
31*b* Inner peripheral second opposing surface
32 Cable pressing protrusion
32*a* First pressing groove
32*b* Second pressing groove
32*c* Central protrusion
32*d*, 32*e* Protrusion
35, 36 Cable supporting arm
35*a*, 36*a* First cable holding groove
35*b*, 36*b* Second cable holding groove
35*c*, 36*c* Retainer protrusion
35*d*, 36*d* Retainer protrusion
35*e*, 36*e* Inclined surface
35*f*, 36*f* Inclined surface
37*a*, 37*b*, 38*a*, 38*b* Protruding member
39 Second locking portion
40 Second locking protrusion
41 Projection wall
42 Abutting surface
43 Space
46 First connecting portion (connecting portion)
47 Second connecting portion (connecting portion)
48 Fold-facilitating portion
50 Relay contact (contact)
51 Base
51*a* Positioning hole
51*b* Space
52 First cable press-contact member
52*a* Top end portion
52*b* Narrow portion
53 First press-contact groove (electrically connecting portion, press-contact groove)
54 Second cable press-contact member
54*a* Top end portion
54*b* Narrow portion
55 Second press-contact groove (electrically connecting portion, press-contact groove)
60 First cable (cable)
61 Core wire
62 Sheath
65 Second cable (cable)
66 Core wire
67 Sheath

70 Filler
70*a* First filler
70*b* Second filler

The invention claimed is:

1. An electrical connector, comprising: a pair of a first fitting object and a second fitting object holding a cable and capable of being fitted together that are connected to each other by a connecting portion;

a first outer peripheral wall and a second outer peripheral wall to form outer peripheral edge portions of said first fitting object and said second fitting object, respectively;

a contact located inside said first outer peripheral wall; and a first filler and a second filler provided respectively to said first fitting object and said second fitting object, wherein said first outer peripheral wall is located on a fitting side with respect to said connecting portion in a fitting direction in which said first fitting object and said second fitting object are fitted to each other, said second outer peripheral wall is located on an opposite side of said fitting side with respect to said connecting portion in said fitting direction, and when said first fitting object and said second fitting object are fitted together, said first filler and said second filler are crushed and integrated to each other expand and contract around said contact, and said first outer peripheral wall is located inside said second outer peripheral wall.

2. The electrical connector according to claim 1, wherein said contact has an electrically connecting portion; and said contact is included with electrically connected to said cable in a state where said first fitting object and said second fitting object are fitted together.

3. The electrical connector according to claim 2, wherein at least one said cable extends outward from said contact arranged inside of said first filler and said second filler when said first fitting object and said second fitting object are fitted together.

4. The electrical connector according to claim 2, wherein said electrically connecting portion is a press-contact groove;

said second fitting object holds at least two said cables; and said contact clamps core wires of said cables by said press-contact groove to electrically connect said cables to each other when said first fitting object and said second fitting object are fitted together.

5. The electrical connector according to claim 2, wherein a corresponding portion of said cable is arranged in said first filler and said second filler that are crushed and integrated to each other, in a cross-sectional view along said fitting direction, when said first fitting object and said second fitting object are fitted together.

6. The electrical connector according to claim 1, wherein said first filler and said second filler are composed of a material mainly comprising urethane acrylate.

* * * * *